United States Patent [19]

Pfeiffer et al.

[11] 4,220,616

[45] Sep. 2, 1980

[54] MELT-SPINNING ACRYLONITRILE POLYMER FIBER USING SPINNERETTE OF HIGH ORIFICE DENSITY

[75] Inventors: Ronald E. Pfeiffer, Pensacola, Fla.; Robert W. Roberts, New London, Mo.

[73] Assignee: American Cyanamid Co.,, Stamford, Conn.

[21] Appl. No.: 938,196

[22] Filed: Aug. 30, 1978

[51] Int. Cl.[2] ..... D01F 7/00

[52] U.S. Cl. ..... 264/206; 264/210.7; 425/72 S; 425/464

[58] Field of Search ..... 264/206, 177 F, 210.7; 425/71, 72 S, 464

[56] References Cited

U.S. PATENT DOCUMENTS

| | | | |
|---|---|---|---|
| 2,465,408 | 3/1949 | Webb et al. | 425/61 |
| 3,621,088 | 11/1971 | Hatcher et al. | 264/210 F |
| 4,163,770 | 8/1979 | Porosoff | 264/342 RE |

FOREIGN PATENT DOCUMENTS

| | | | |
|---|---|---|---|
| 2403947 | 8/1974 | Fed. Rep. of Germany | 264/202 |
| 43-26354 | 11/1968 | Japan | 264/206 |
| 45-3289 | 2/1970 | Japan | 425/464 |

*Primary Examiner*—Jay H. Woo
*Attorney, Agent, or Firm*—William J. Van Loo

[57] ABSTRACT

Fusion melts of acrylonitrile polymer and water are effectively melt-spun through spinnerettes of high capillary density without sticking together of the individual filaments.

5 Claims, 2 Drawing Figures

CB—DIAMETER AS REQUIRED FOR AT LEAST ABOUT 18 HOLES PER SQUARE CENTIMETER

D—DIAMETER OF CAPILLARY

S—SPACING AS REQUIRED FOR AT LEAST ABOUT 18 HOLES PER SQUARE CENTIMETER

CB—DIAMETER AS REQUIRED FOR AT LEAST ABOUT 18 HOLES PER SQUARE CENTIMETER

D—DIAMETER OF CAPILLARY

S—SPACING AS REQUIRED FOR AT LEAST ABOUT 18 HOLES PER SQUARE CENTIMETER

Figure 1:
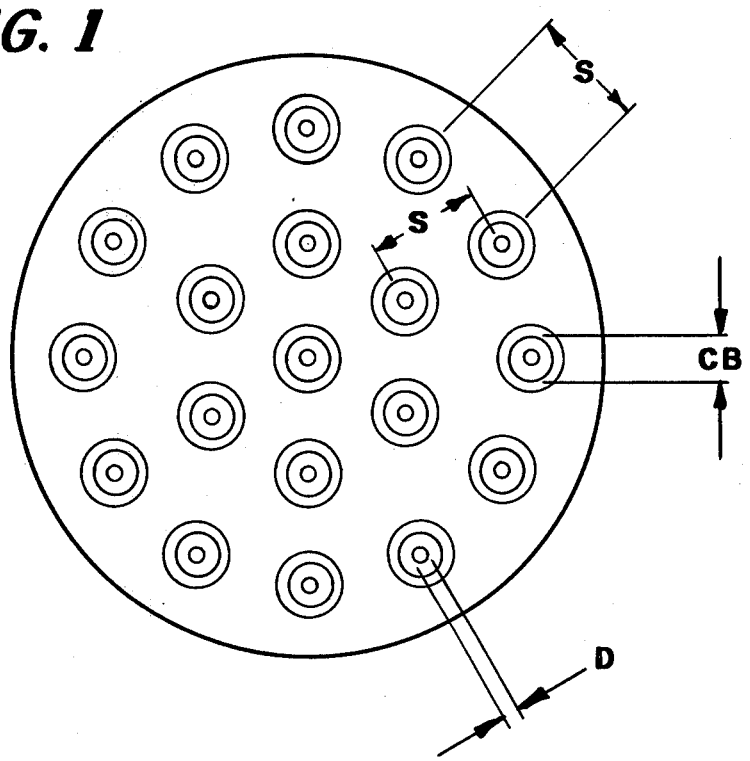

MELT-SPINNING ACRYLONITRILE POLYMER FIBER USING SPINNERETTE OF HIGH ORIFICE DENSITY

This invention relates to a process for melt-spinning fiber forming polymers at an increased production rate per spinerette. More particualarly, this invention relates to such a process wherein a spinnerette with more orifices per given area is employed than has been possible heretofore.

In conventional melt-spinning of fibers, a fiber-forming polymer is heated to a temperature at which it melts, is extruded through a spinnerette plate to form filaments which rapidly cool to become solid, and the resulting filaments are then further processed to provide the desired fiber. The spinnerette plate that is employed in such processing must contain capillaries to provide the desired filaments while satisfying two additional requirements. The capillaries must be of such dimensions as to satisfy back-pressure limitation requirements and must be sufficiently spaced from one another as to prevent premature contact between the emerging fibers that would result in sticking together or fusion of filaments with one another. To satisfy the back-pressure limitation requirements, the capilaries are provided with counterbores of sufficient diameter and depth.

Recent developments in the field of fiber spinning, especially acrylic fibers, had led to the development of fusion melts which can be extruded through a spinnerette plate to provide filaments. These fusion melts comprise a homogeneous composition of a fiber-forming polymer and a melt assistant therefor. The melt assistant is a material which enables the polymer to form a melt at a temperature below which the polymer would normally melt or decompose and becomes intimately associated with the molten polymer so that a single-phase melt results. The melt assistant must be used in proper proportions with the polymer to provide the single-phase fusion melt. If a low boiling melt assistant is used, the melt assistant in proper amounts and the polymer often must be heated at elevated temperatures to provide the fusion melt. Since the temperature at which the fusion melt forms is above the boiling point of the melt assistant at atmospheric pressure, consequently superatmospheric pressures are necessary to keep the melt assistant in the system. Such fusion melts have been effectively spun into fiber using spinnerette plates similar to those employed in conventional melt-spinning.

Because the requirement for adequate spacing of the capillaries in spinnerette plates used for conventional melt-spinning to prevent premature contact between the nascent filaments which would result in their sticking together, the number of capillaries that can be provided in a given spinnerette plate is greatly restricted. As a result, production capacity of a spinnerette with a given surface area is limited and usually large tow bundles can only be produced by combining the outputs from a series of spinnerettes. This, in turn, requires costly installations of additional spinnerettes, specially designed conduits and spin packs to ensure an even distribution of the melt to all spinning holes, provision of space for installation, and further power consumption to operate the increased number of spinnerettes.

There exists, therefore, the need for processes for providing fiber by melt spinning which enable the productivity of spinnerettes to be increased. Such provision would fulfill a long-felt need and constitute a significant advance in the art.

In accordance with the present invention, there is provided a process for melt-spinning an acrylonitrile polymer fiber which comprises providing a homogeneous fusion melt of a fiber-forming acrylonitrile polymer and water at a temperature above the boiling point of water at atmospheric pressure and at a temperature and pressure which maintains water in single phase with said polymer and extruding said fusion melt through a spinnerette assembly containing a spinnerettte plate having an orifice density of at least about 18 per square centimeter directly into a steam-pressurized solidification zone maintained under conditions such that the rate of release of water from the nascent extrudate avoids deformation thereof.

The present invention, by employing a fusion melt of an acrylonitrile fiber-forming polymer and water at atmospheric pressure and at a temperature and pressure that maintains water and the polymer in a single phase and by extruding the fusion melt directly into a steam-pressurized solidification zone maintained under conditions such that the rate of release of water from the nascent extrudate avoids deformation thereof, provides filamentary extrudates which do not stick together as they emerge from the spinnerette orifices. Since the filaments have no tendency to stick together as they emerge from the spinnerette, the orifices of the spinnerette plate can be located closer together and more orifices can be provided in the spinnerette plate. As a result, the productivity of a spinnerette can be greatly increased without negatively affecting the quality of the resulting fiber.

The spinnerette plate used in the process of the present invention contains a much greater density of orifices per unit area than do conventional spinnerette plates used in melt spinning by conventional procedures. Typically, prior art melt-spinning spinnerette plates have a density of about 5–10 orifices per square centimeter at most. In the process of the present invention the spinnerette plate contains at least about 18 orifices per square centimeter, preferably at least at 25, 50 or more per sq. centimeter, each of typical conventional diameter, usually about 200–400 micron diameter. This enables the process of the present invention to provide an increase in productivity from a given spinnerette of at least about 180%. Since processing of the melt is under conditions which lead to nascent extrudates which do not stick together or deform, the higher density of spinnerette orificies is possible.

Figure 2:
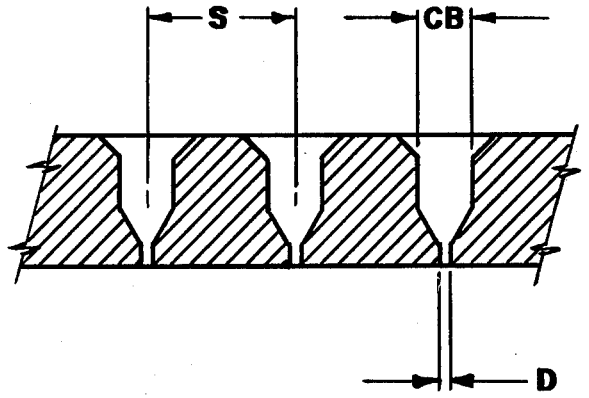

A typical spinnerette plate useful in the process of the present invention is shown in the accompanying drawings in which FIG. 1 respresents a top view of the spinnerette plate showing the close packing of the spinnerette orifices and FIG. 2 shows a cross-sectional view of the same spinnerette plate showing details of the counterbores and capillaries comprising the orificies.

In carrying out the process of the present invention, it is necessary to provide a homogeneous fusion melt of an acrylonitrile fiber-forming polymer and water. Any fiber-forming acrylonitrile polymer that can form a fusion melt with water at atmospheric pressure and at a pressure and temperature sufficient to maintain water and the polymer in a single fluid phase can be used in the process of the present invention. Polymers falling into this category are know in the art. The fusion melt is prepared at a temperature above the boiling point at atmospeheric pressure of water and eventually reaches a temperature and pressure sufficient to maintain water and the polymer in a single fluid phase.

The homogeneous fusion melt thus provided is extruded through the spinnerette plate of high orifice density directly into a steam-pressurized solidification zone maintained under conditions of pressure and saturation such that the rate of release of water from the nascent extrudate avoids deformation thereof. By controlling the rate of release of water from the nascent extrudate, such deformations thereof as foamed structure, inflated structure, pock-marked structure, and the like which adversely affect processability are avoided and continuous processing can be effected in spite of the high density of orifices in the spinnerette plate. The extruded filaments are also free of any tendency to stick together due to their nature. The homogeneous fusion melt is a special type of melt that requires the combination of proper amounts of water and polymer, high temperature, and superatmospheric pressure. Slight variations in these critical features lead to solidification of the polymer which in solidified form exhibits no tendency toward stickiness. The extruded filaments are processed further according to conventional procedures to provide desirable filamentary materials which may have application in textile and other applications. A desirable processing step is that of stretching the extrudate while it is in the solidification zone. Preferably streching is accomplished at a stretch ratio of at least about 25. More preferably stretching is effected in two or more stages with the strech ratio in the first stage being less than that of subsequent stages.

The invention is more fully illustrated in the examples which follow wherein all parts and percentages are by weight unless otherwise specified.

COMPARATIVE EXAMPLE A

A single phase fusion melt was prepared using a copolymer containing 89.3% acrylonitrile and 10.7% methyl methacrylate and having an intrinsic viscosity of 1.52. This fusion melt was extruded through a spinnerette having 1266 capillaries each of diameter 200 microns. Each of the capillaries was centered in a counterbore of 2.0 millimeters in diameter and dispersed at a spacing of 4.0 millimeters center-to-center in the spinnerette plate, the density of orifices being 5 per square centimeter of spinnerette plate extrusion surface. Extrusion was conducted at 176°C. and the extrudate issued directly into a solidification zone maintained at 25 psig (130° C.) with saturated steam. The extrudate was subjected to a first stage of stretching at a stretch ratio of 3.2 and a second stage of stretching at a stretch ratio of 13.6 while the extrudate remained in the solidification zone. The stretch ratio was the speed of the extrudate take-up relative to the linear flow of fusion melt through the spinnerette. The total stretch ratio obtained was 43.5. The extrudate, representing a bundle of filaments, which emerged from the solidification zone was relaxed in saturated steam at a pressure of 18 psig (124° C.) during which a shrinkage of 28 % occurred. The fiber before relaxation was 5.4 denier/filament and 7.2 denier/filament after relaxation. Relaxed fiber properties were as follows:

Straight tenacity (grams/denier): 6.5;
Straight elongation (%): 33.0;
Loop tenacity (grams/denier): 4.2;
Loop elongation (%): 24.0.

EXAMPLE 1

Following the procedure of Comparative Example A in every material detail except for the spinnerette plate employed, an additional extrusion run was made. In this example, a smaller spinnerette plate was employed but it contained 2937 orifices each of 200 micron diameter centered in counterbores of 1.0 millimeter diameter, the density of orifices being 67 per square centimeter of spinnerette plate extrusion surface.

The spinnerette is illustrated by FIGS. 1 and 2 except for the actual number of orifices. In FIG. 1, the spacing between centers of counterbores is illustrated as S, the counterbore diameter as CB and the orifice diameter as D. FIG. 2 shows a cut-away side view showing countersinks, counterbores and orifices of a portion of the spinnerette plate.

Extrusion was conducted without any sticking together of individual filaments and fiber identical to that obtained in Comparative Example A was obtained.

COMPARATIVE EXAMPLE B

The procedure of Example 1 was repeated in every material detail except that a polypropylene melt free of melt assistant and designated as fiber grade having a melt index of 3 (Trademark Rexene PP- 3153 ) was employed and extrusion was conducted at 260–280° C. directly into air. The extrudates stuck together as they emerged from the spinnerette and the desired individual filaments could not be obtained.

Example 1 compared to Comparative Example A shows that the process of the present invention provides desirable fiber using closely spaced orifices. Comparative Example B compared to Example 1 shows that other melt-spinning compositions are not effectively processed using closely spaced orifices.

EXAMPLES 2–5

Again following the procedure of Example 1, a series of runs were made in which the spacing of the orifices in the spinnerette plate was varied. In each instance fiber of substantially the same properties as those of the fiber of Example 1 was obtained. Example numbers and spinnerette plate details are given below:

| | Overall | Capillary | | | Counterbores | |
|---|---|---|---|---|---|---|
| Example | Plate Diameter (mm) | Diameter (Mμ) | No. | Density | Diameter (mm) | Spacing* (mm) |
| 2 | 381 | 200 | 5,016 | 18 | 1.8 | 2.2 |
| 3 | 279 | 200 | 9,060 | 25 | 1.5 | 1.7 |
| 4 | 279 | 200 | 5,016 | 18 | 2.0 | 2.2 |
| 5 | 432 | 200 | 30,000 | 54 | 1.2 | 1.3 |

*Spacing of counterbores center to center.

We claim

1. A process for melt-spinning an acrylonitrile polymer fiber which comprises providing a homogeneous fusion melt of a fiber-forming acrylonitrile polymer and water at a temperature above the boiling point of water at atmospheric pressure and at a temperature and pressure which maintains water in single phase with said polymer and extruding said fusion melt through a spinnerette assembly containing a spinnerette plate having an orifice density of at least about 25 per square centimeter, each orifice consisting of a capillary of about 200–400 micron diameter centered in a counterbore, directly into a steam-pressurized solidification zone maintained under conditions such that the rate of release of water from the nascent extrudate avoids deformation thereof.

2. The process of claim 1 wherein said orifice density is at least about 50.

3. The process of claim 1 wherein the nascent extrudate is stretched while in said solidification zone.

4. The process of claim 3 wherein said stretch ratio is at least about 25.

5. The process of claim 3 wherein said stretching is effected in at least two stages, the first being at a stretch ratio less than that of the subsequent stages.

* * * * *